US012104377B2

(12) United States Patent
Oliver

(10) Patent No.: US 12,104,377 B2
(45) Date of Patent: Oct. 1, 2024

(54) INSULATED MODULAR BRICK SYSTEM AND METHODS

(71) Applicant: CSR Products LLC, Tucker, GA (US)

(72) Inventor: Colin R. Oliver, Tucker, GA (US)

( * ) Notice: Subject to any disclaimer, the term of this patent is extended or adjusted under 35 U.S.C. 154(b) by 241 days.

(21) Appl. No.: 17/638,643

(22) PCT Filed: Feb. 28, 2020

(86) PCT No.: PCT/US2020/048545
§ 371 (c)(1),
(2) Date: Feb. 25, 2022

(87) PCT Pub. No.: WO2021/041910
PCT Pub. Date: Mar. 4, 2021

(65) Prior Publication Data

US 2022/0298790 A1 Sep. 22, 2022

Related U.S. Application Data

(60) Provisional application No. 62/893,400, filed on Aug. 29, 2019.

(51) Int. Cl.
*E04C 1/00* (2006.01)
*E04C 2/288* (2006.01)
*E04C 2/00* (2006.01)

(52) U.S. Cl.
CPC ..... *E04C 2/288* (2013.01); *E04C 2002/007* (2013.01)

(58) Field of Classification Search
CPC ..... E04C 2/288; E04C 2002/007
See application file for complete search history.

(56) References Cited

U.S. PATENT DOCUMENTS 3,881,289 A 5/1975 Mauroner
4,299,069 A * 11/1981 Neumann ..... E04C 2/30 52/309.4
4,920,716 A 5/1990 Coffey
5,325,652 A * 7/1994 Feder ..... B32B 9/04 52/249
5,685,523 A * 11/1997 Sugiyama ..... E04H 17/1404 256/73
6,240,691 B1 * 6/2001 Holzkaemper ..... E04B 1/942 52/387

(Continued)

FOREIGN PATENT DOCUMENTS

CN 109372128 A 2/2019

*Primary Examiner* — Basil S Katcheves
(74) *Attorney, Agent, or Firm* — Daniel J. Santos

(57) ABSTRACT

An insulated modular brick system is provided that has the aesthetic qualities of a traditional brick system, that is cost effective, that has insulating characteristics, and that requires less labor to install than traditional brick systems and the aforementioned thin brick or brick veneer alternatives. The system comprises one or more insulated modular brick panels designed to be installed on a substrate of a building structure. The panel comprises an insulating foam core having a preselected thickness, an encapsulating material encapsulating the insulating foam core on at least first, second and third sides of the insulating foam core, and a plurality of thin bricks partially embedded in at least a front face of the encapsulating material at preselected locations.

19 Claims, 17 Drawing Sheets

(56) References Cited

U.S. PATENT DOCUMENTS

| | | | | |
|---|---|---|---|---|
| 6,360,505 | B1 * | 3/2002 | Johns | E04F 13/147 52/311.1 |
| 7,025,539 | B2 * | 4/2006 | Irvine | E02D 5/03 405/278 |
| 9,353,523 | B2 * | 5/2016 | Taylor, Jr. | E04F 13/165 |
| 9,840,851 | B2 * | 12/2017 | Propst | E04B 1/941 |
| 2004/0065034 | A1 * | 4/2004 | Messenger | E04C 2/2885 52/309.11 |
| 2005/0066587 | A1 * | 3/2005 | Brisson | E04C 2/288 52/79.1 |
| 2007/0144093 | A1 * | 6/2007 | Messenger | E02D 27/02 52/309.12 |
| 2011/0023396 | A1 | 2/2011 | Schwarz et al. | |
| 2011/0239566 | A1 * | 10/2011 | Ciuperca | E04C 2/20 52/432 |
| 2013/0074433 | A1 * | 3/2013 | Ciuperca | E04B 1/41 52/698 |
| 2014/0083033 | A1 * | 3/2014 | McIntosh | E04F 13/0885 52/302.1 |
| 2014/0083040 | A1 * | 3/2014 | Taylor, Jr. | E04F 13/14 52/741.1 |
| 2014/0260034 | A1 * | 9/2014 | Ciuperca | E04C 5/125 52/405.3 |
| 2017/0037639 | A1 * | 2/2017 | Taylor, Jr. | E04F 13/165 |
| 2017/0298627 | A1 * | 10/2017 | VanHoose | E04C 2/288 |

* cited by examiner

| Test Method | Property | Age | Average Test Result |
|---|---|---|---|
| ASTM C109 | Compressive Strength (psi) | 24 hrs | 2,810 |
| | | 7 days | 6,060 |
| | | 28 days | 6,660 |
| ASTM C307 | Tensile Strength (psi) | 7 days | 555 |
| | | 28 days | 595 |
| ASTM C947 | Flexural Strength (psi) | 7 days | 620 |
| | | 28 days | 735 |
| ASTM C348 | Flexural Strength (psi) | 24 hrs | 785 |
| | | 7 days | 905 |
| | | 28 days | 1,285 |
| ASTM C1583 | Tensile Bond Strength (psi) | 28 days | 20 (100% Substrate Failure) |
| ASTM C157 | Length Change - Air Cured (% Change) | 28 days | -0.135 |
| ASTM C666 | Freeze/Thaw Durability (Relative Dynamic Modulas, %) | 300 Cycles | 100 |
| ASTM C666 per C1364 *All sides are saw cut to expose aggregate | Freeze/Thaw Durability (Relative Dynamic Modulas, %) | 300 Cycles | 100 |
| ASTM C666 per C1364 *All sides are saw cut to expose aggregate | Freeze/Thaw Durability (CPWL, %) | 300 Cycles | 0 |
| ASTM C642/C1195 | Absorption - Cold Water (%) | 28 days | 5.8 |
| | Absorption - Boiling Water (%) | | 9 |
| | Apparent Density | | 2 |
| | Permeable Voids (%) | | 16.6 |

Fig. 15

INSULATED MODULAR BRICK SYSTEM AND METHODS

CROSS-REFERENCE TO RELATED APPLICATIONS

This is a PCT international application that claims priority to, and the benefit of the filing date of, U.S. provisional application No. 62/893,400, filed on Aug. 29, 2019, entitled "AN INSULATED MODULAR BRICK SYSTEM AND METHODS," which is incorporated herein by reference in its entirety.

TECHNICAL FIELD

The present disclosure discloses an insulated modular brick system and method for fabricating and installing the insulated modular brick system.

BACKGROUND

The conventional method of installing masonry is one brick at a time, which requires a large amount of in-site materials, labor and additional costs. Attempts have been made to develop systems that provide the same aesthetic appearance as traditional brick systems while reducing materials, labor and costs associated with traditional brick masonry. For example, "thin brick" systems and "brick veneer" systems exist that are marketed as light-weight alternatives to traditional brick systems. Such systems can be combined with insulating materials for improved energy efficiency. Installing such systems, however, is a fairly labor-intensive process in that it requires individually attaching the thin bricks or brick veneers to a base that has been mechanically attached to a framed structure. Some of these thin brick systems can be prone to bricks popping off in severe weather conditions.

A need exists for a system that overcomes the aforementioned disadvantages of existing thin brick systems, that has the aesthetic qualities of a traditional brick system, that is cost effective, that has insulating characteristics, and that requires less labor to install than traditional brick systems and the aforementioned thin brick or brick veneer alternatives.

SUMMARY

The present disclosure relates to an insulated modular brick panel designed to be installed on a substrate of a building structure, an insulated modular brick system comprising the panel, a method for making the panels. The panel comprises an insulating foam core having a preselected thickness, an encapsulating material encapsulating the insulating foam core on at least first, second and third sides of the insulating foam core, and a plurality of thin bricks partially embedded in at least a front face of the encapsulating material at preselected locations.

In accordance with an embodiment, the encapsulating material has at least a first clip attachment formed in an upper surface thereof. The first clip attachment can be configured to receive a first clip for attaching the panel to a second insulated modular brick panel.

In accordance with an embodiment, the encapsulating material has at least a second clip attachment formed in a lower surface thereof. The second clip attachment can be configured to receive a second clip for attaching the panel having the second clip attachment to a third insulated modular brick panel.

In accordance with an embodiment, the encapsulating material has a J-track formed therein. The J-track can be configured to receive an attachment mechanism for attaching the panel to the building structure such that a weight of the panel is supported by the building structure.

In accordance with an embodiment, the plurality of thin bricks comprises multiple rows of thin bricks partially embedded in the front face of the encapsulating material at preselected locations. Each row of thin bricks is laterally offset from an adjacent rows of thin bricks by a preselected distance, L/2, where L is equal to the length of each thin brick.

In accordance with an embodiment, the panel has at least first and second joints for joining the panel laterally with first and second panels, respectively. The panel comprises preselected locations in the rows that are empty of thin bricks. The preselected locations that are empty of thin bricks have lengths equal to L/2. The preselected locations of length L/2 that are empty of thin bricks align with preselected locations of length L/2 that are empty of thin bricks in an adjoining panel such that the aligned empty locations, once joined, are sized to receive a full thin brick of length L.

In accordance with an embodiment, the panel has at least first and second interlocking joints on first and second sides, respectively, of the panel for joining the panel laterally with first and second panels that each have the first and second interlocking joints on first and second sides of the first and second panels.

In accordance with an embodiment, the first interlocking joint has interlocking pockets and interlocking legs and the second interlocking joint has interlocking pockets and interlocking legs.

In accordance with an embodiment, the interlocking pockets and interlocking legs of the first interlocking joint alternate row by row such that each row of the panel that ends with an interlocking pocket on the first side of the panel is adjacent to a row on the first side of the panel that ends with an interlocking leg.

In accordance with an embodiment, the interlocking pockets and interlocking legs of the second interlocking joint alternate row by row such that each row of the panel that ends with an interlocking pocket on the second side of the panel is adjacent to a row on the second side of the panel that ends with an interlocking leg.

In accordance with an embodiment, the encapsulating material is a glass fiber reinforced concrete (GFRC) coating.

The insulated modular brick system comprises a plurality of the insulated modular brick panels that are attached to one another by clips.

The process for fabricating an insulated modular brick system, the process comprises:

- placing thin brick tiles in respective pockets of a customized mold, the pockets being sized and shaped to receive the thin brick tiles;
- pouring an encapsulating matrix material into the mold such that the encapsulating matric material is in contact with back surfaces of the thin brick tiles and is disposed in between sides of adjacent thin brick tiles;
- placing a foam core comprising insulating material in the mold in contact with the encapsulating matrix material such that a front face of the foam core is substantially parallel with the back surfaces of the brick tiles; and
- allowing the encapsulating matrix material to cure or harden.

These and other features and advantages will become apparent from the following description, drawings and claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 15 shows a table of test data for a few representative embodiments of the insulated modular brick panels.

DETAILED DESCRIPTION

The present disclosure discloses an insulated modular brick system that has the aesthetic qualities of a traditional brick system, that is cost effective, that has insulating characteristics, and that requires less labor to install than traditional brick systems and the aforementioned thin brick or brick veneer alternatives. The system comprises one or more insulated modular brick panels designed to be installed on a substrate of a building structure. The panel comprises an insulating foam core having a preselected thickness, an encapsulating material encapsulating the insulating foam core on at least first, second and third sides of the insulating foam core, and a plurality of thin bricks partially embedded in at least a front face of the encapsulating material at preselected locations.

The panels preferably are made via a casting process during which an insulating foam core is encapsulated in an encapsulating material along with a thin-brick pattern that gives the panel the aesthetic look of a solid brick wall. Custom molds can be used during the casting process for casting the panels. The panels are then allowed to cure. Once the panels are cured to the desired strengths, they can be inspected and reviewed for quality control prior to being released for shipment.

Figure 17:
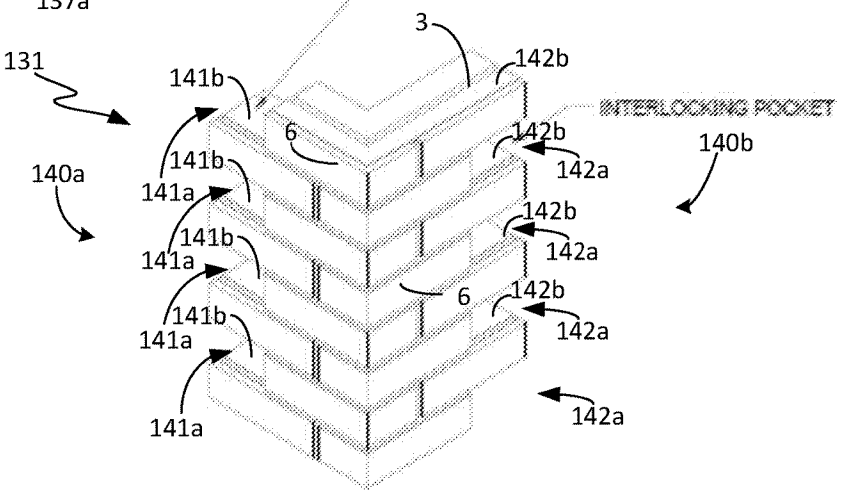
FIG. 17 shows a front perspective view of a return insulated modular brick panel in accordance with another representative embodiment having an interlocking configuration that is configured to interlock with the panel shown in FIG. 16A.
Figure 18:
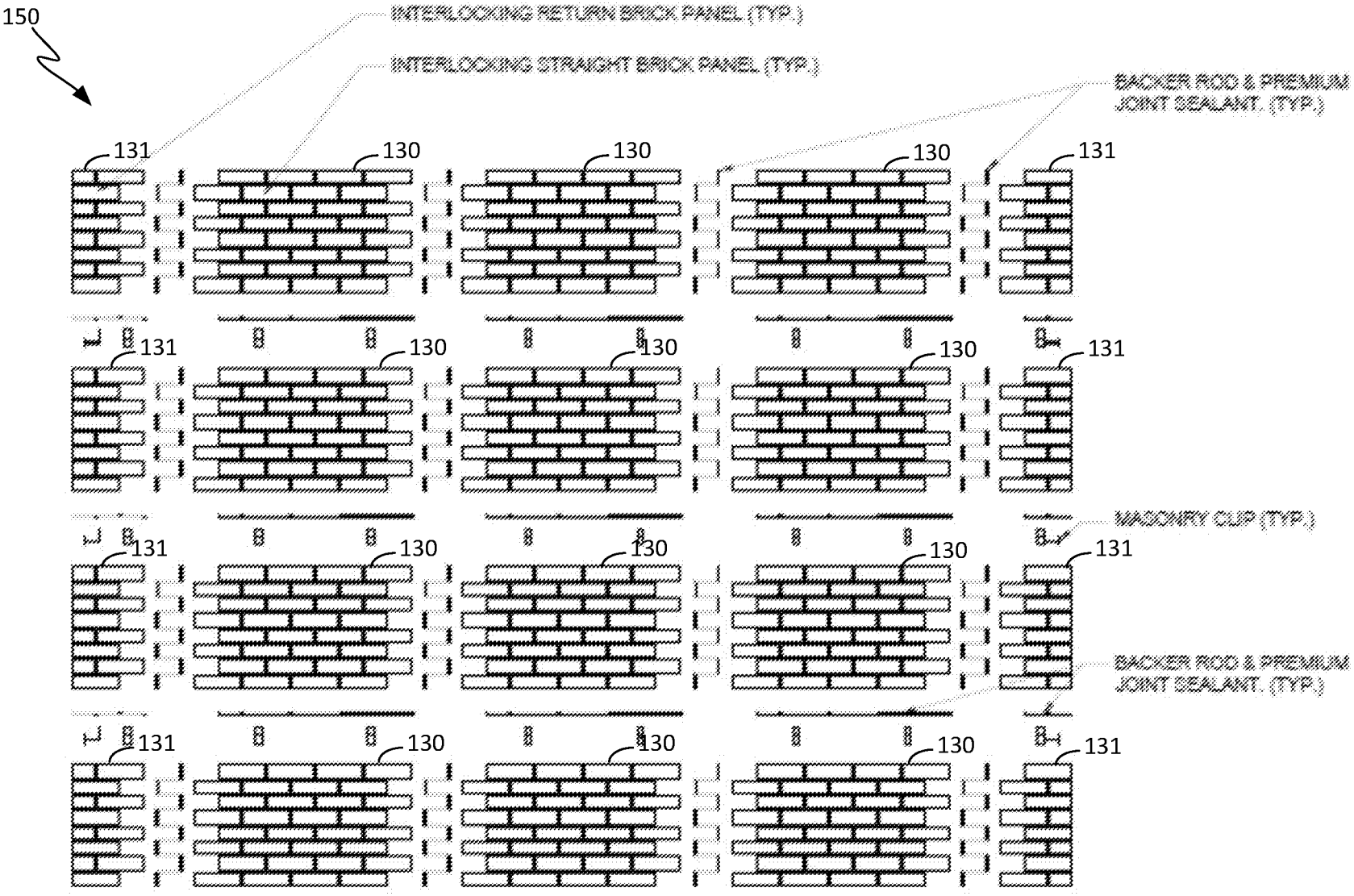
FIG. 18 is a plan view of an example of the insulated modular brick system 150 comprising a plurality of the panels 130 and 131 shown in FIGS. 16A-17 showing the manner in which they can be joined.

FIGS. 1-13B and 16A-18 show several representative embodiments of insulated modular brick panels that can be used to construct the insulated modular brick system. The inventive principles and concepts are not limited to insulated modular brick panels having the configurations shown in FIGS. 1-13B and 16A-18. The representative embodiments of the panels shown in FIGS. 1-13B and 16A-18 are examples of possible configurations from which the insulated modular brick system can be constructed. FIGS. 14 and 18 provide examples of the insulated modular brick systems.

Figure 1:
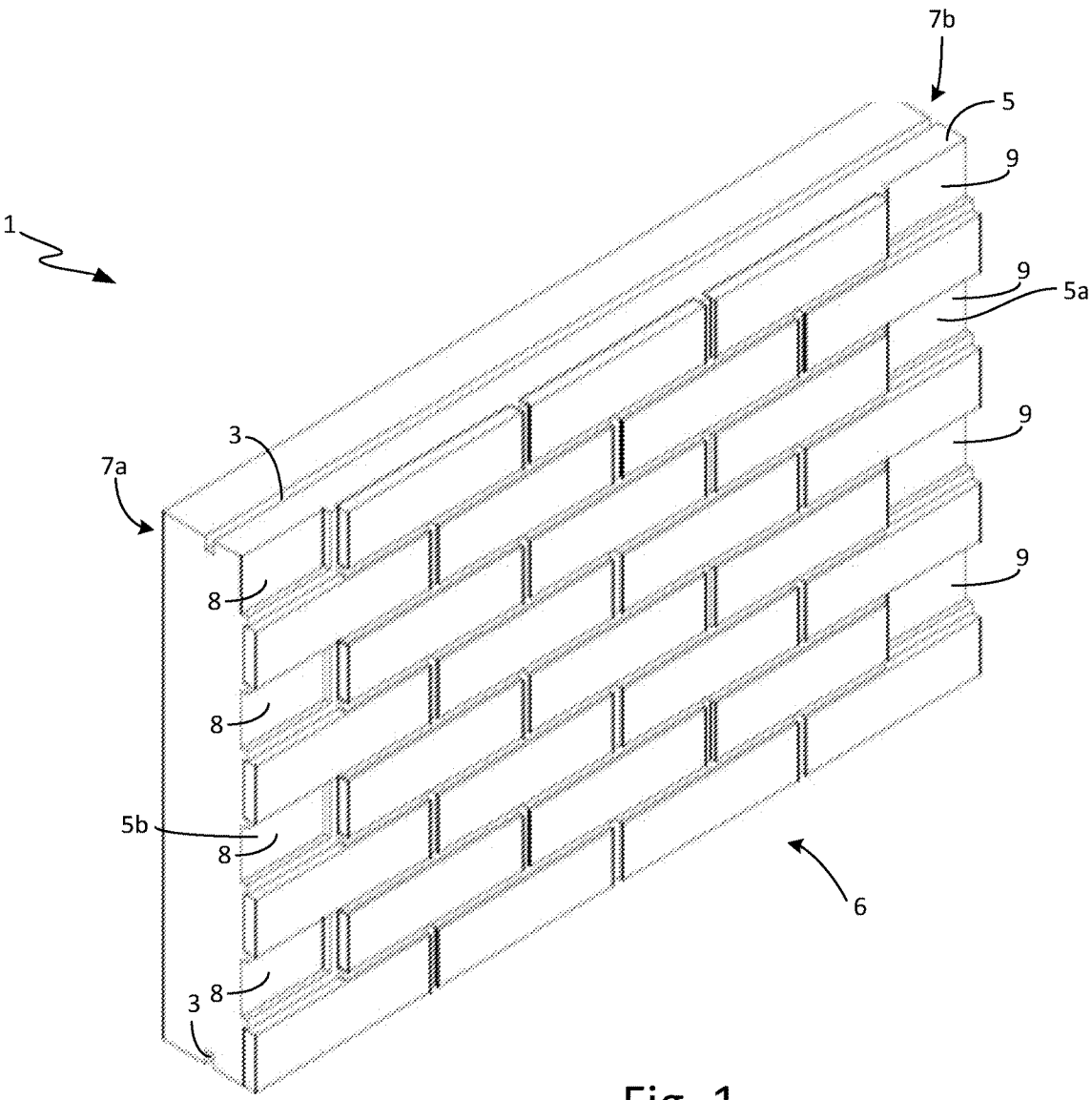
FIGS. 1 and 2 show straight and return insulated modular brick panels, respectively, in accordance with a representative embodiment.
Figure 2:
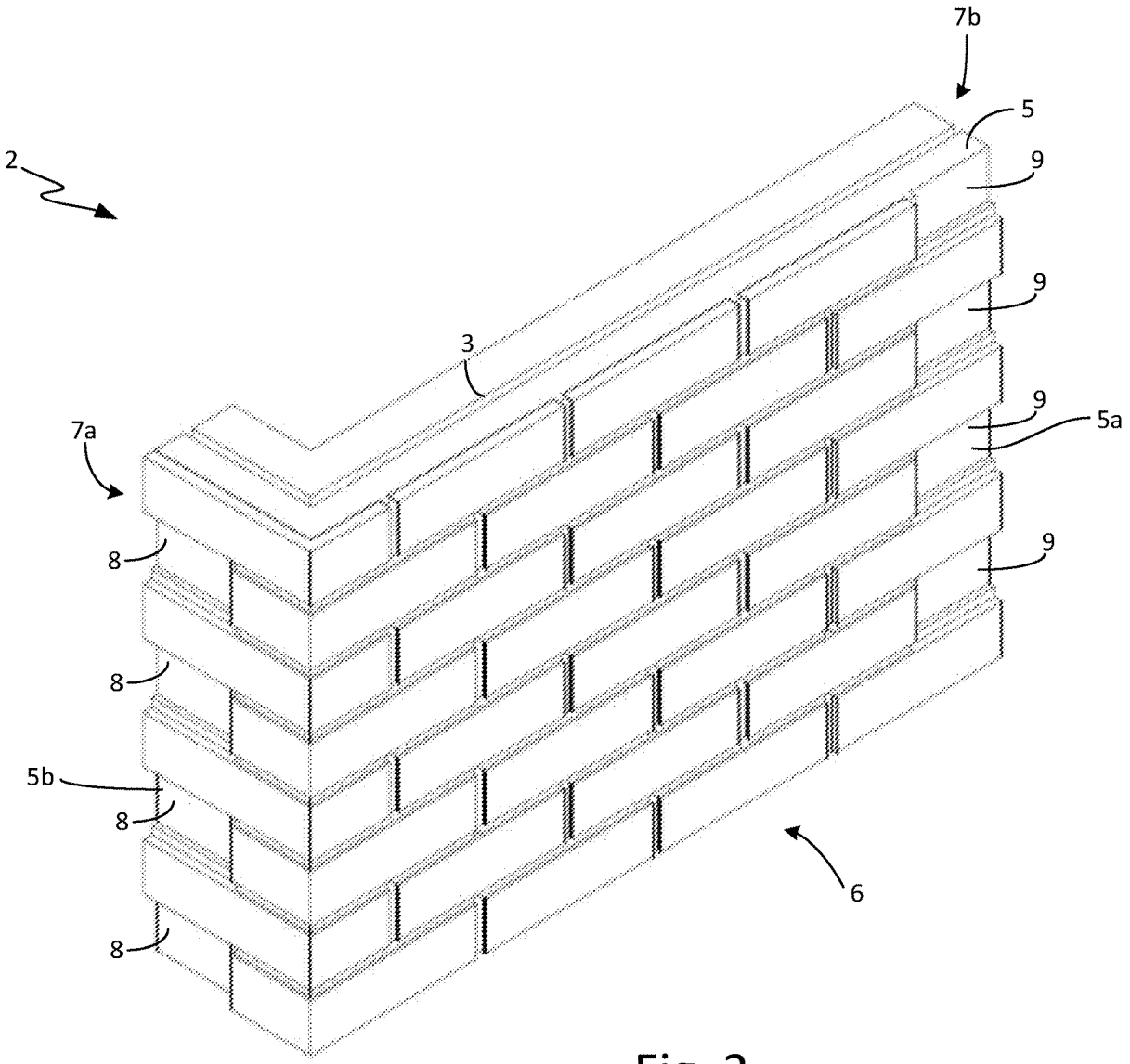
Figure 3:
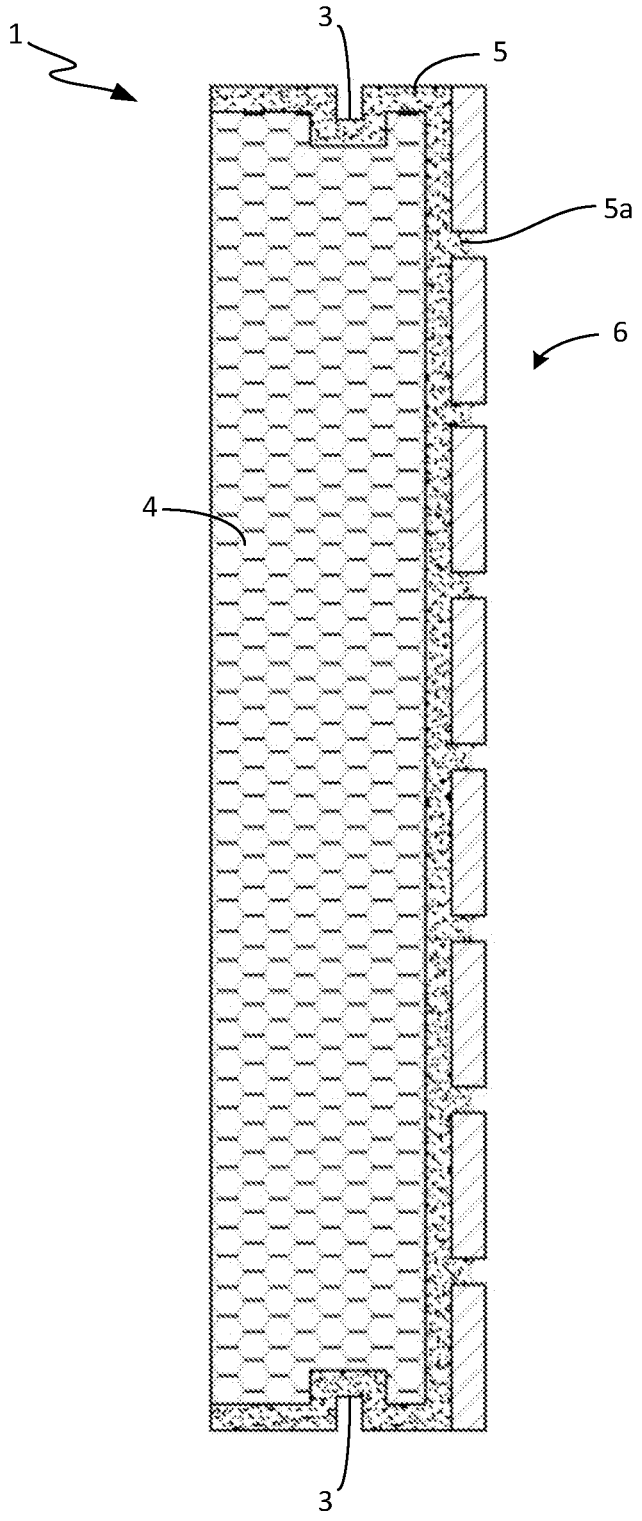
FIG. 3 is a cross-sectional side view of the panel shown in FIG. 1.

FIGS. 1 and 2 show straight and return insulated modular brick panels 1 and 2, respectively, each having a clip attachment portion 3. FIG. 3 is a cross-sectional side view of the panel 1 shown in FIG. 1. As can best be seen in FIG. 3, the insulating foam core 4 is encapsulated on at least three sides of the core 4 in an encapsulating material 5. The encapsulating material 5 has a thin-brick pattern 6 embedded in a front face 5*a* of the panel 1. In FIG. 2, the thin-brick pattern 6 is also embedded in a side face 5*b* of the encapsulating material 5. The thin-brick pattern 6 comprises a plurality of thin bricks arranged in rows at preselected locations, with each row of thin bricks being laterally offset relative to the adjacent row(s) of thin bricks. For example, if each thin brick has a length, L, the adjacent row(s) of thin bricks will typically be laterally offset by an amount equal to L/2.

At the joints of each panel, there are preselected locations that are absent of thin bricks. With reference to FIG. 1, the panel 1 has first and second joints 7*a* and 7*b*, respectively, at which the panel 1 is intended to be joined with adjoining panels (not shown). At these joints 7*a* and 7*b*, the locations 8 and 9, respectively, having lengths equal to L/2 are left empty of thin bricks so that once the panel 1 is joined at joints 7*a* and 7*b* with adjoining panels (not shown), the empty locations 8 and 9 will align with empty locations in the adjoining panels that are also of length L/2. The aligned empty locations, once joined, are sized to receive a full thin brick (i.e., a thin brick of length L) after the panels have been adjoined. In this manner, the joints are "hidden," or "blended," i.e., they appear seamless. If the panel 1 is not intended to be joined with adjoining panels, thin bricks of length L/2 will be embedded in the encapsulating material 5 at the locations 8 and 9 during the casting process.

A variety of encapsulating materials are suitable for use as the encapsulating material 5. The encapsulating material is typically a glass fiber reinforced concrete (GFRC) coating. A few examples of suitable encapsulating materials include, but are not limited to, cementitious or acrylic and polymer-based materials.

The insulating foam core 4 is typically 4 inches thick and has a standard R-16 insulation value. It should be noted, however, that the inventive principles and concepts are not limited with respect to the type, thickness or insulating value of the insulating core 4. The core thickness can be sized to meet any local codes requirements.

Figure 4:
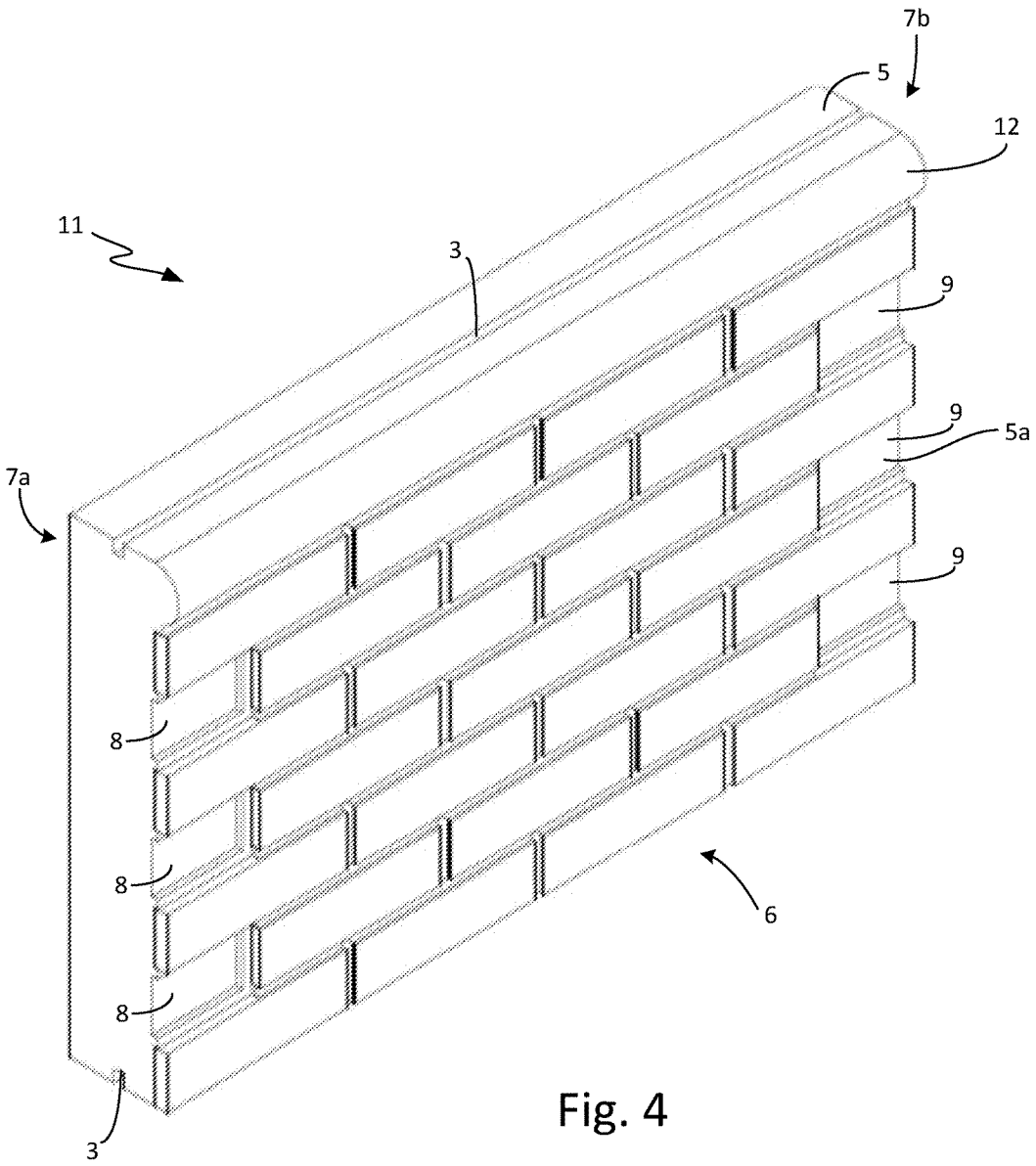
FIGS. 4 and 5 show straight and return insulated modular brick panels, respectively, in accordance with a representative embodiment.
Figure 5:
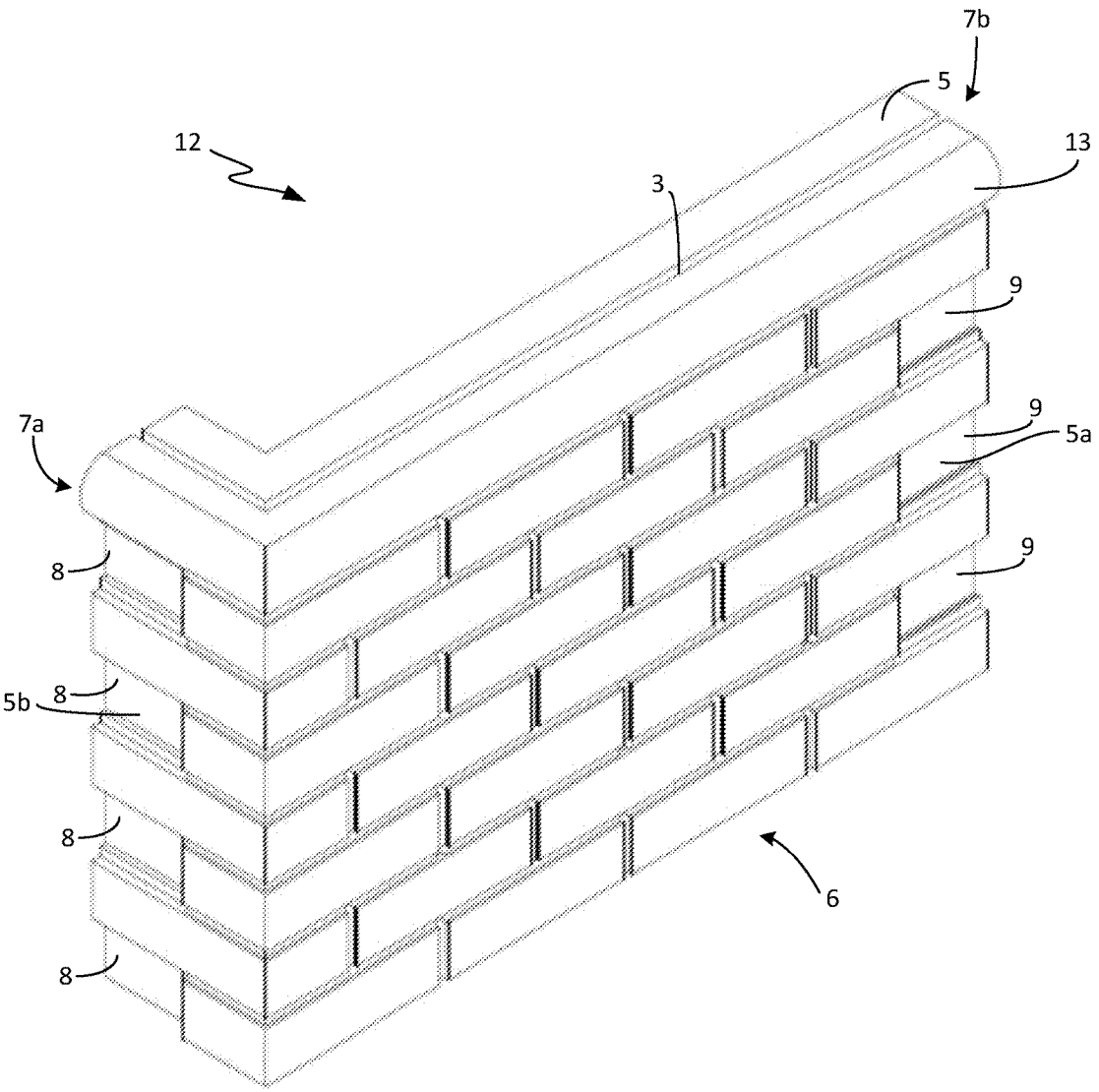
Figure 6:
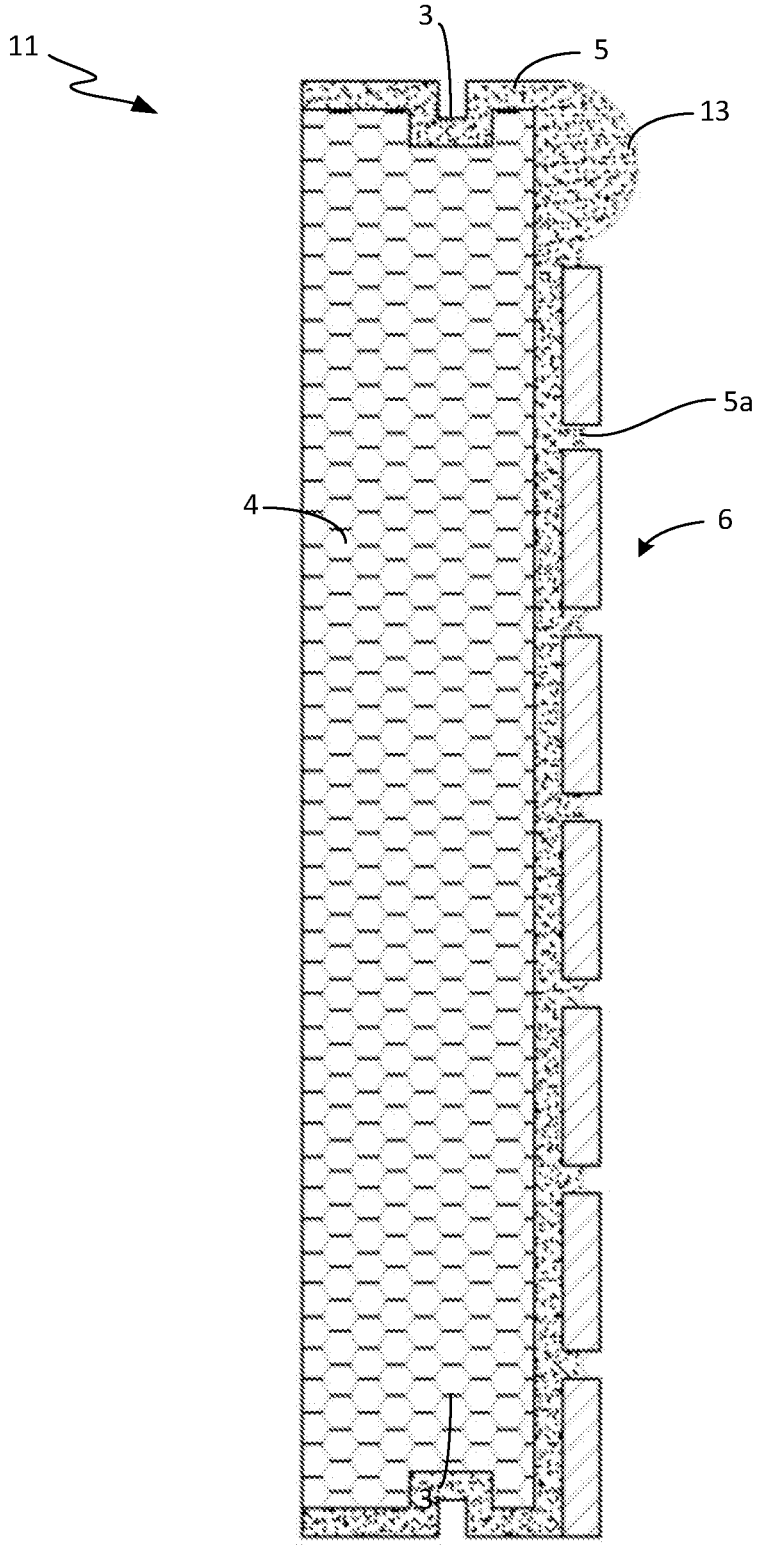
FIG. 6 is a cross-sectional side view of the panel shown in FIG. 4.

FIGS. 4 and 5 show straight and return insulated modular brick panels 11 and 12, respectively, each having a clip attachment portion 3. FIG. 6 is a cross-sectional side view of the panel 11 shown in FIG. 4. The panels 11 and 12 are identical to the panels 1 and 2, respectively, except that the panels 11 and 12 include a feature 13 known in the industry as a bullnose.

Figure 7:
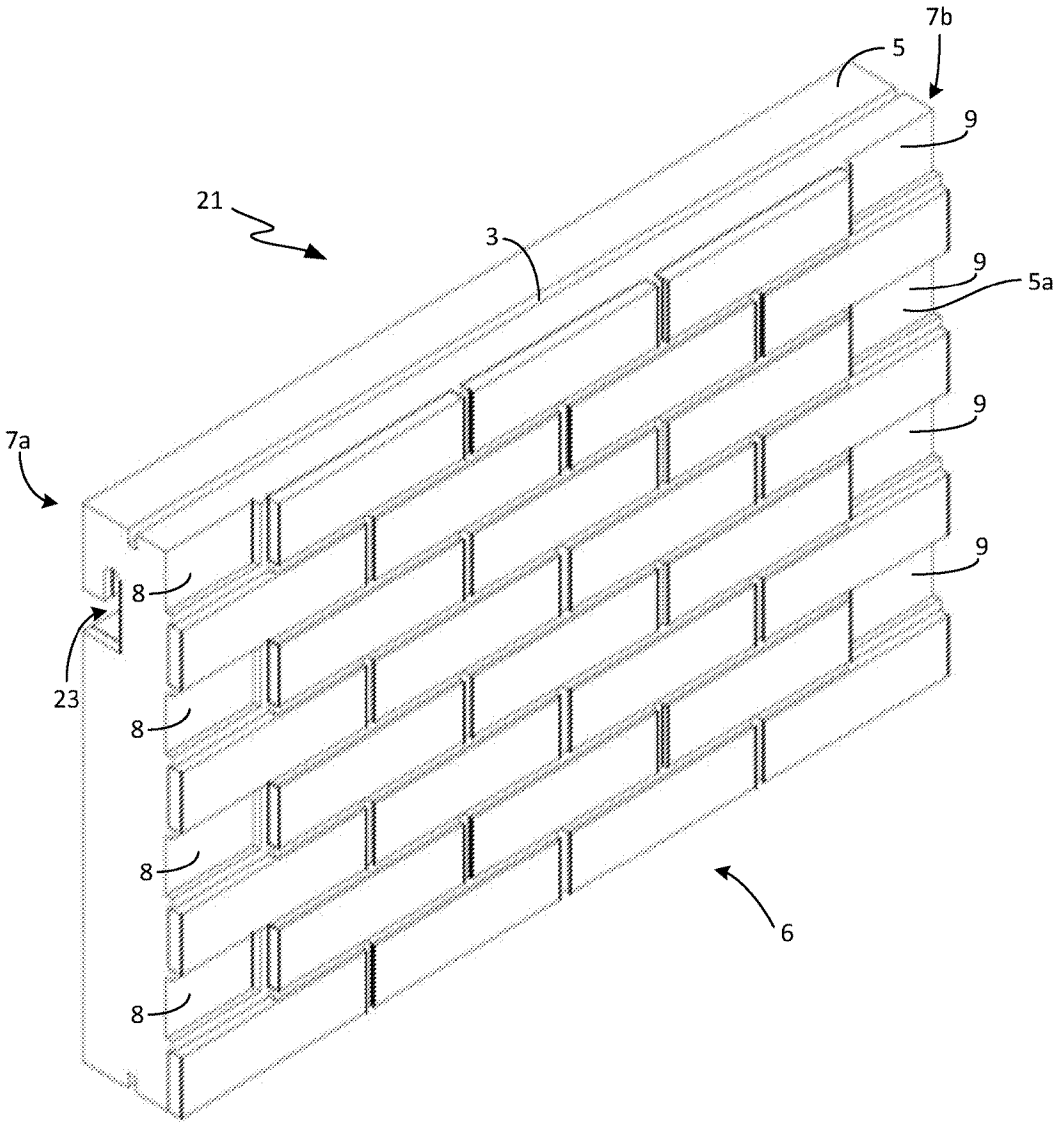
FIGS. 7 and 8 show straight and return insulated modular brick panels, respectively, in accordance with a representative embodiment.
Figure 8:
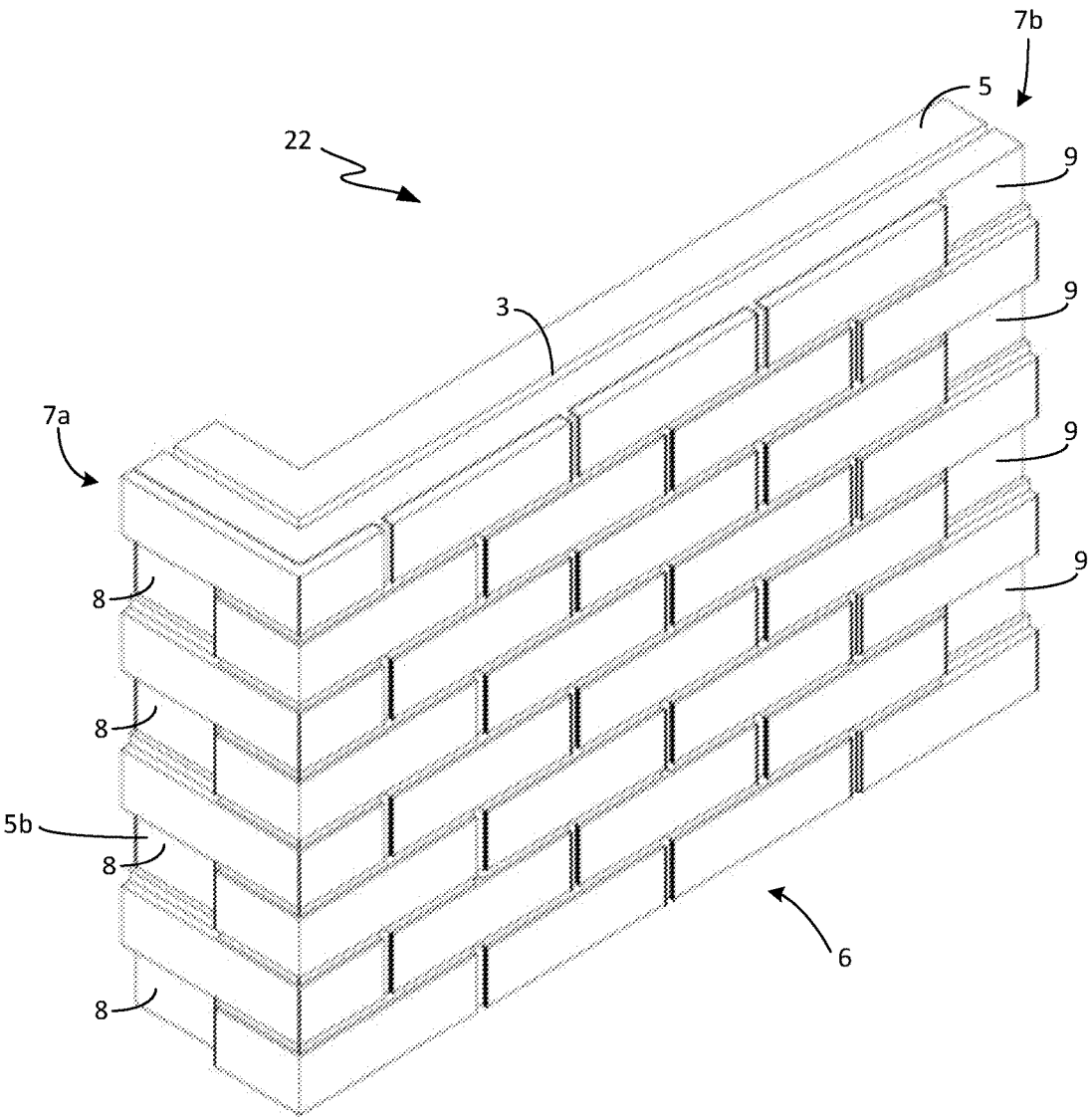
Figure 9:
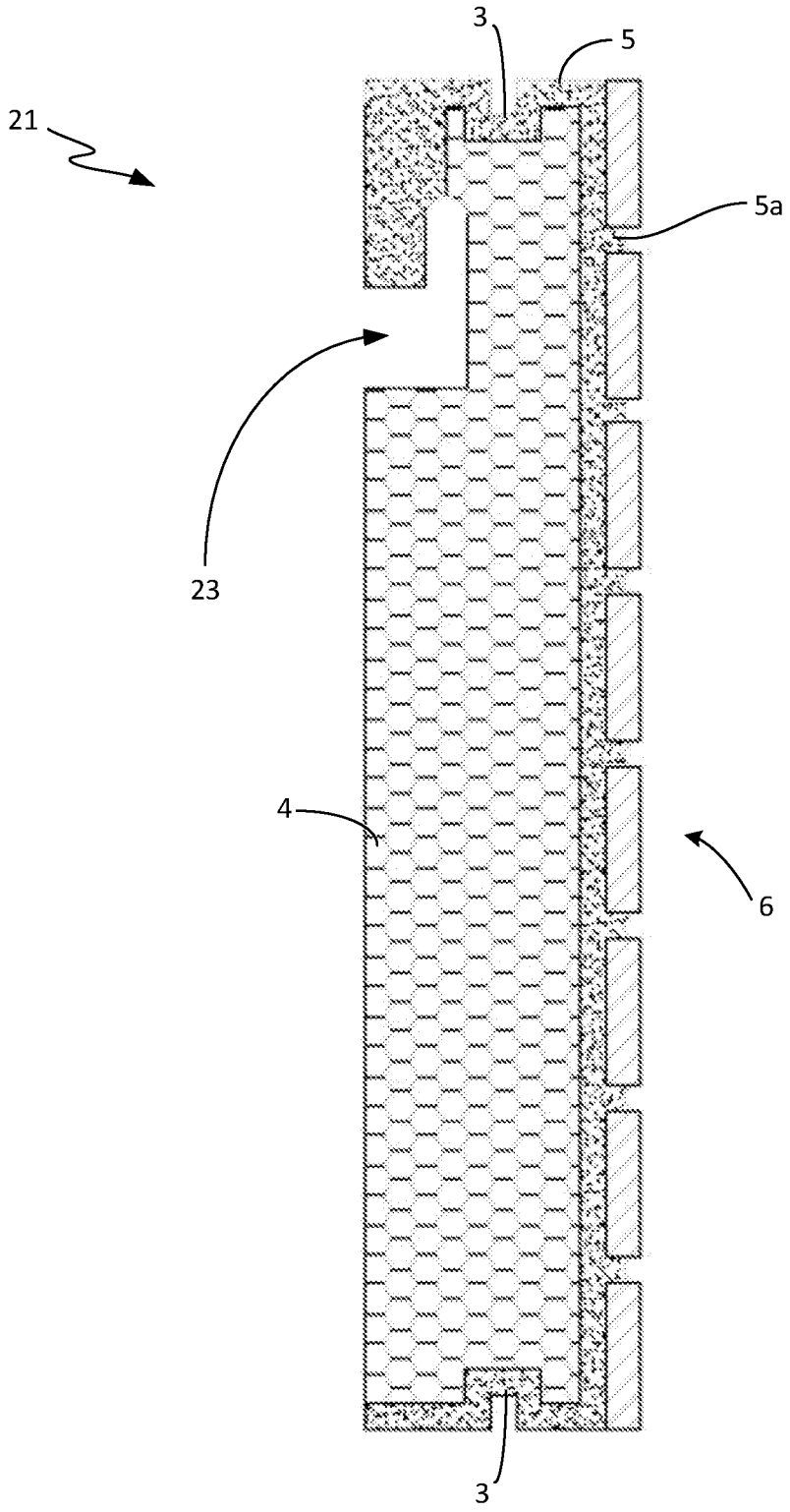
FIG. 9 is a cross-sectional side view of the panel shown in FIG. 7.

FIGS. 7 and 8 show straight and return insulated modular brick panels 21 and 22, respectively, each having a clip attachment portion 3. FIG. 9 is a cross-sectional side view of the panel 21 shown in FIG. 7. The panels 21 and 22 are identical to the panels 1 and 2, respectively, except that the panels 21 and 22 include a J-track 23. The purpose of the J-track is described below in detail in the description of the installation process for installing an insulated modular brick system.

Figure 10:
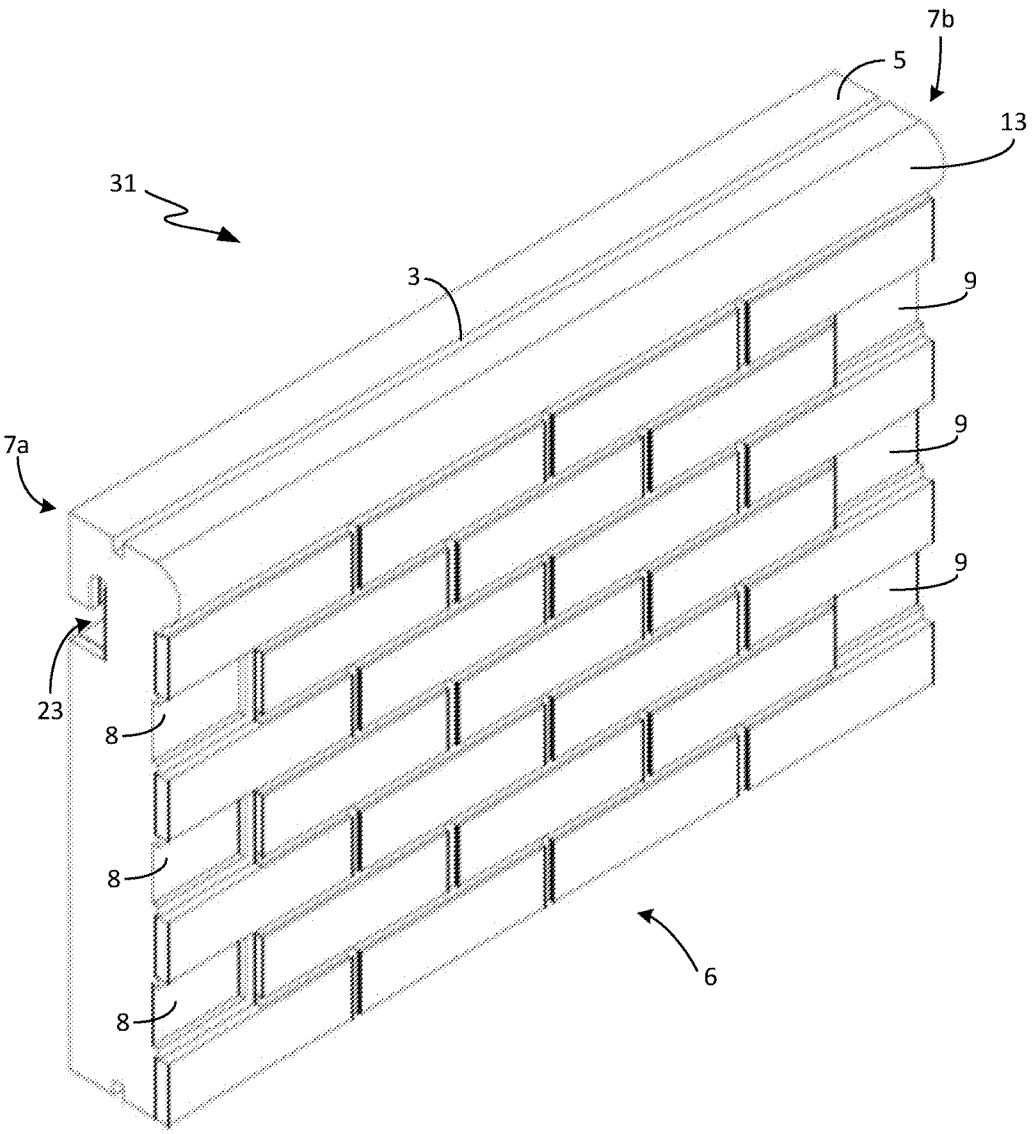
FIGS. 10 and 11 show straight and return insulated modular brick panels, respectively, in accordance with a representative embodiment.
Figure 11:
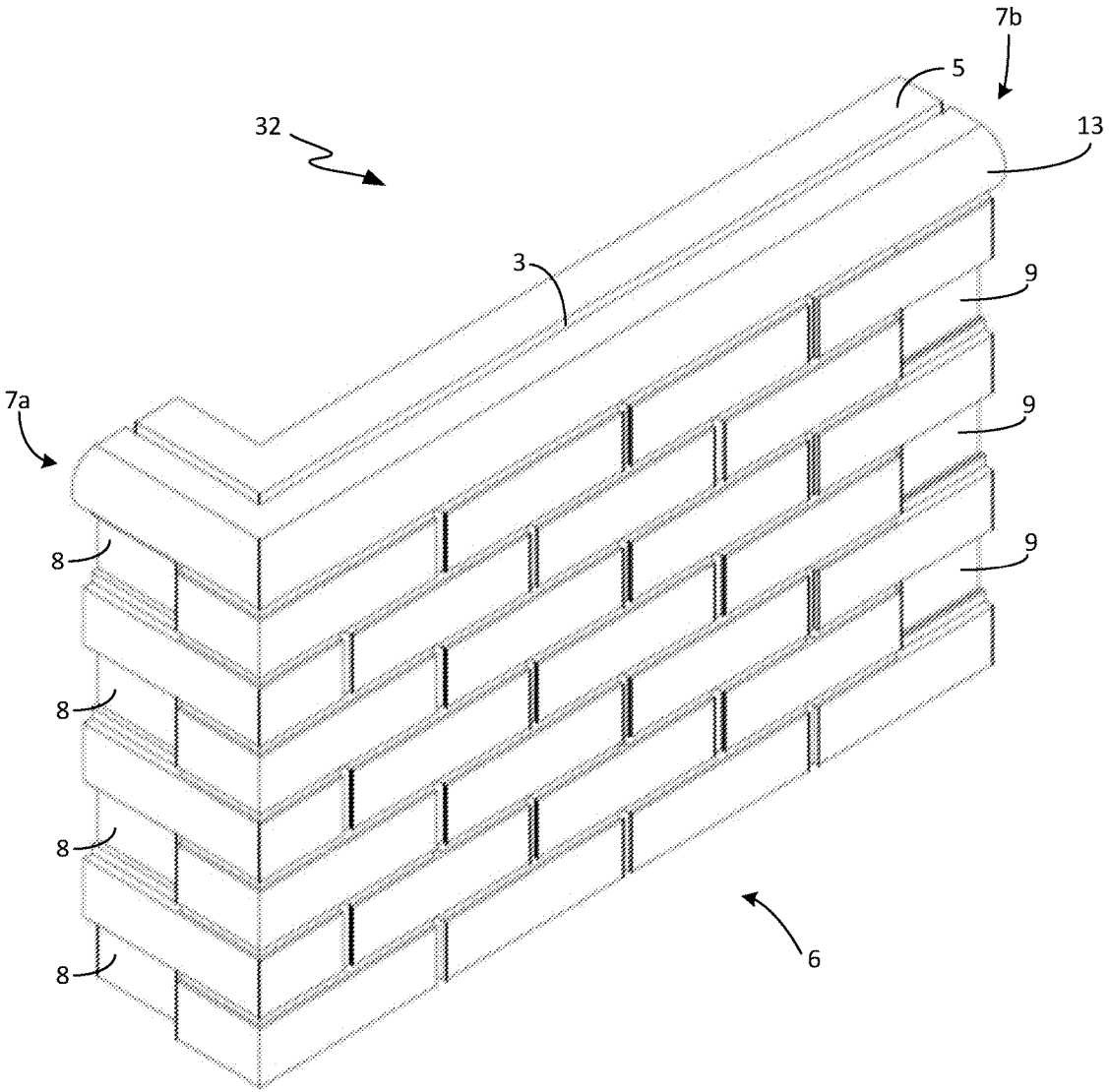
Figure 12:
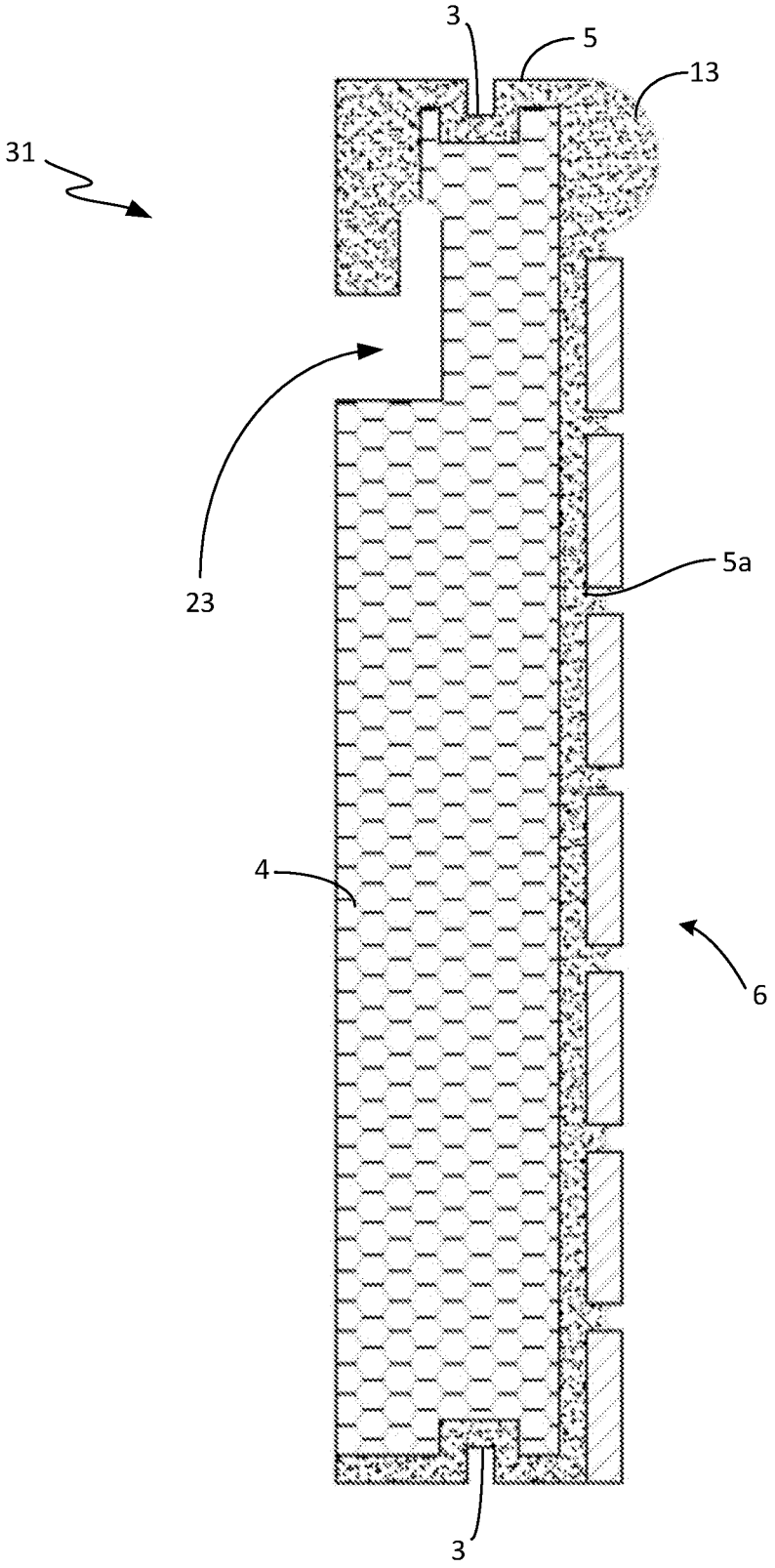
FIG. 12 is a cross-sectional side view of the panel shown in FIG. 10.

FIGS. 10 and 11 show straight and return insulated modular brick panels 31 and 32, respectively, each having a clip attachment portion 3. FIG. 12 is a cross-sectional side view of the panel 31 shown in FIG. 10. The panels 31 and 32 are identical to the panels 21 and 22, respectively, except that the panels 31 and 32 include the bullnose feature 13. Like the panels 21 and 22, the panels 31 and 32 include the J-tracks 23.

Figure 13A:
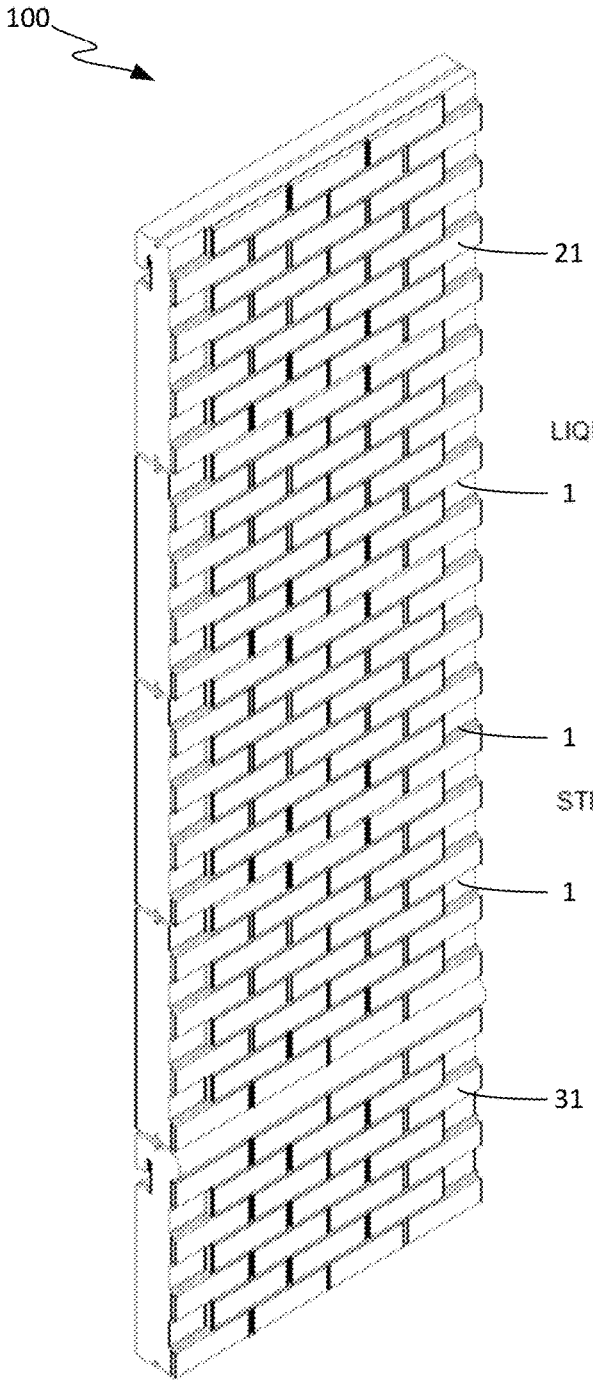
FIGS. 13A and 13B show front perspective and side cross-sectional views, respectively, of an insulated modular brick system in accordance with a representative embodiment that has been constructed using one of the panels shown in FIG. 7, three of the panels shown in FIG. 1 and one of the panels shown in FIG. 10.
Figure 13B:
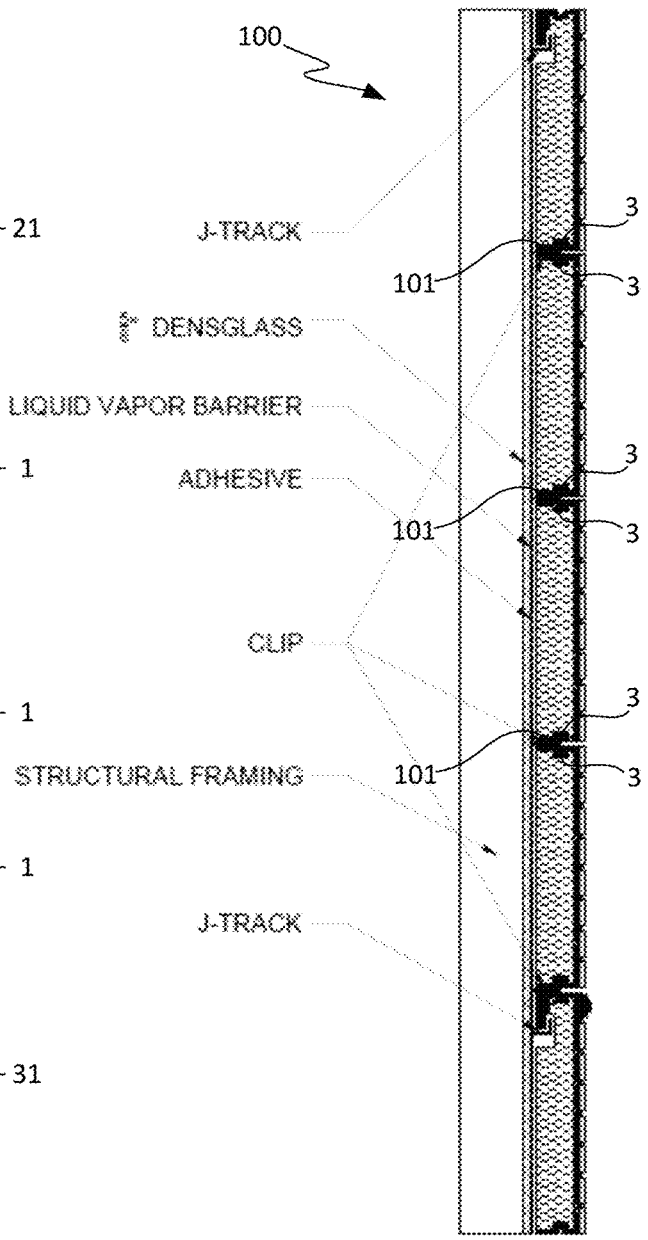
Figure 14:
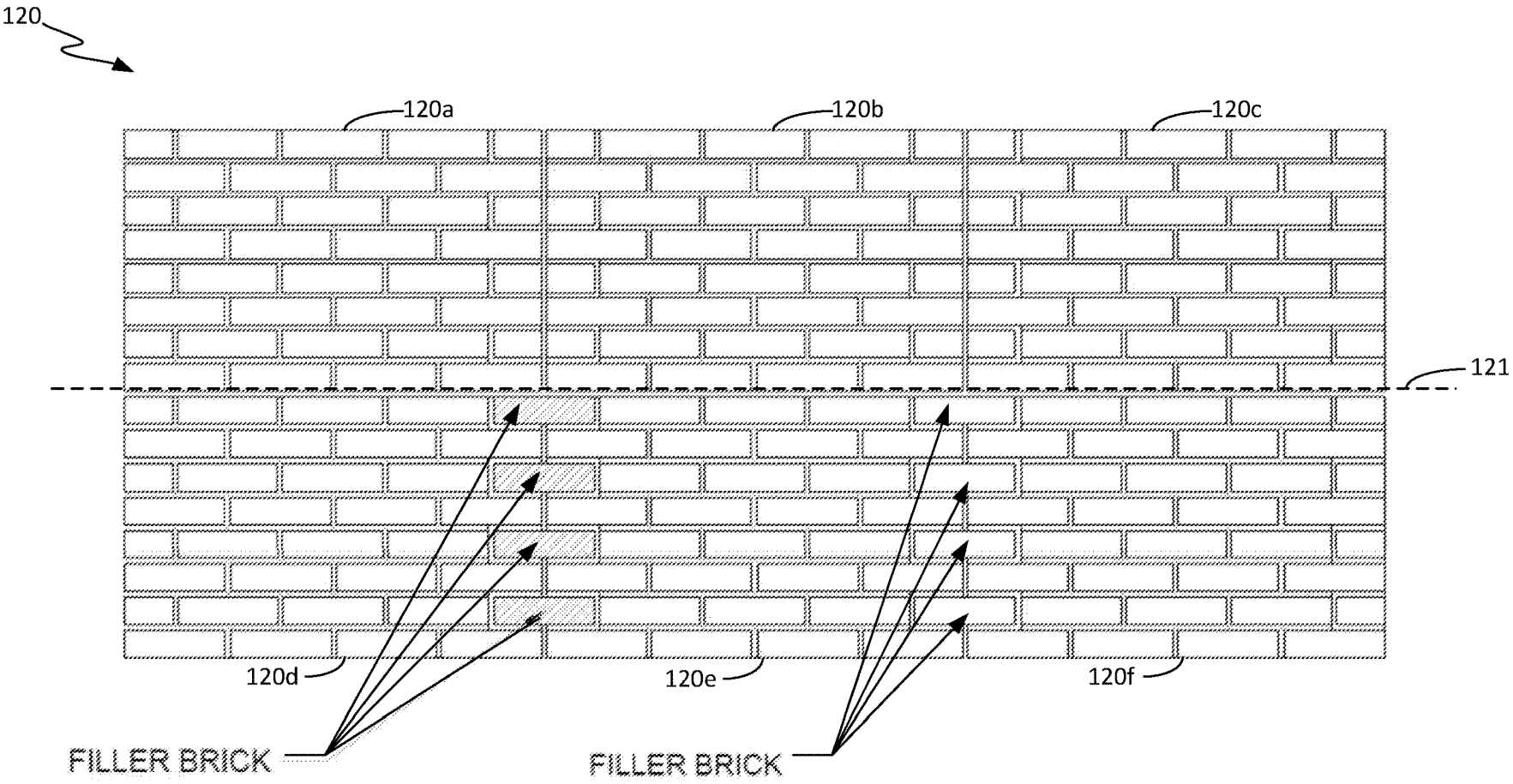
FIG. 14 shows an elevation view of the insulated modular brick system in accordance with a representative embodiment that has been constructed using six insulated modular brick panels.

FIGS. 13A and 13B show front perspective and side cross-sectional views, respectively, of an insulated modular brick system 100 in accordance with a representative embodiment that has been constructed using one of the panels 21 shown in FIG. 7, three of the panels 1 shown in FIG. 1 and one of the panels 31 shown in FIG. 10. The clips 101 that are held in the clip attachment areas 3 can be seen in FIG. 13B.

FIG. 14 shows an elevation view of the insulated modular brick system 120 in accordance with a representative embodiment that has been constructed using six insulated modular brick panels 120*a*-120*f*. Dashed line 121 indicates where the three upper panels 120*a*-120*c* are joined with the three lower panels 120*d*-120*f*, respectively. The filler thin bricks discussed above that are installed after a panel has been adjoined laterally with another panel are not needed for all laterally adjoining panels in order to provide the visual effect of seamlessness at the joints. For example, in the representative embodiment shown FIG. 14, the filler bricks are only used at the joints where panel 120*d* is adjoined with panel 120*e* and where panel 120*e* is adjoined with panel 120*f*. The upper panels 120*a*-120*c* are just set in place without using the filler bricks, and yet the entire system has the seamless visual effect of traditional brick masonry. This further reduces the labor, materials and cost associated with installing the system without sacrificing the aesthetic qualities or structural integrity.

The Casting Process

As indicated above, the insulated modular brick system 100 replaces the old method of installing masonry, one brick at a time, which requires a large amount of on-site materials, labor and additional costs.

The insulated modular brick panels preferably are cast using the encapsulating material 5, which encapsulates the insulating form core 4 with the thin-brick pattern 6 partially embedded in a front and/or side face of the encapsulating material 5, which gives the panel the aesthetic look of a solid brick wall. Molds having preselected shapes and sizes are used for casting the panels and then the panels are allowed to cure in a temperature-controlled manufacturing facility. Once the panels have been cured to the required strengths, they preferably are inspected and reviewed by quality control personnel and released for shipment if they pass the inspection and review process.

The mold is customized to receive the thin brick tiles and to create pockets for the thin brick tiles that will be installed on-site at the joints 7*a* and 7*b*. Once the thin brick tiles have been placed in the mold, casting of the encapsulating matrix material can begin. The matrix material is cast to a set point in the mold. The foam comprising the foam core 4 is then placed in the mold. Once the foam is set, the excess matrix material is removed. The product is allowed to cure in a controlled environment for eight hours. The cured matrix material functions as the grout in between adjacent thin brick tiles as well as the mechanism that holds the entire panel together. Thus, the need to perform grouting during the installation process is eliminated. The part is then removed from the mold. The quality control inspection and review processes are then performed. The panels are then palletized for shipping.

Site Preparation

The general contractor or subcontractor for the project will typically process a full pre-install review/checklist of the substrate which includes building verification, shop drawings, and layouts. This pre-installation review/checklist will reduce labor and material costs, waste, and require less alterations to panels on-site.

The Installation Method

Comprehensive shop and setting drawings, detailing joint layout, fabrication details, setting and part numbers are engineered and stamped to meet local Code requirements. The panels are installed using adhesive and mechanical attachments. The adhesive is applied to the back of the panel, in a pattern detailed by our engineer, then the panel is lined up with the layout/shop drawings. Once the panel is positioned it is mechanically attached/clipped back to the structure.

At certain levels of the building, a J-track mechanical attachment method is used to carry the weight of the panel. This is the purpose for the J-tracks shown in FIGS. 7, 9, 10, 12, 13A and 13B. Preferably the panels will be positioned on a spacer (placed at both horizontal/vertical joints) to control the joint size and maintain uniformity. At panel joints, such as joints 7*a* and 7*b*, a bead of latex caulk preferably is installed, which allows for movement in the structure and provides for a water-tight wall system. For multi-story panel applications, preferably all joints are filled with a grout. As seen in FIGS. 1-13B, there will typically only be two joints on any sized modular panel. Once the installation of all panels is complete, the subcontractor/installer will typically clean the wall surface with approved cleaner, as with traditional brick.

Some Benefits of the Insulated Modular Brick Panel

In accordance with some embodiments, some of the benefits are:

- Standard R-16 insulation value, e.g., 4" insulation thickness—each panel provides standard R-16 value and eliminates the need for an additional 2" rigid insulation. Additional insulation thickness can be added for local Code requirements.
- Lightweight Panels—panels can be only 15 lbs. per square foot vs. precast panels at 52 lbs. psf. and traditional brick at 24 lbs. psf.

Reduced Structural Load—panels are lightweight and reduce the overall load on the building structure and simplify connections.

Reduced Labor and Installation Costs—panels can be pre-fabricated, lightweight, and require less equipment and manpower for installation. Detailing issues can be resolved with architect and subcontractor prior to fabrication.

Faster Installation On-Site—fast-track schedules can be maintained by pre-fabricating the panels in advance while the foundation and structure are under construction. Panel installation can be completed rapidly, even in inclement weather.

Panels directly applied to substrate—panels are watertight and fully encapsulated and can be applied directly over an approved water-borne weather barrier.

Factory Controlled manufacturing—all panels can be manufactured in a factory/temperature-controlled environment with comprehensive quality control standards. Design Freedom—brick panels offer the architect freedom of design. Custom colors, textures, and special designs are available. Panels are pre-fabricated per detail requirements of individual projects.

Wide Variety of Standard panels—Examples include pre-fabricated soldier courses, window headers, water tables, pilasters, column wraps, corners, custom pieces, and large cornice panels are available for project requirements.

Sustainability—panel production produces less waste than traditional brick systems with fewer natural resources. Prefabrication is done in a controlled facility and less on-site waste is produced. By producing the panel system in a controlled facility, it is possible to reduce the amount of waste sand, brick and cement that is typically put into the jobsite dumpster. Reducing waste onsite reduces the environmental foot print and costs.

Wind Resistance—panels have been tested and maintain a high degree of peak pull-off standards and perform well in high wind or hurricane zones. The pull-out strength can be, for example, 181 lbs per sq inch. This type of bond strength will prevent any brick from popping off during severe weather conditions.

Durable Long-Lasting Design—panels are durable, low maintenance, and watertight. Panels are considered a 75-year product (0.01% degradation in 300 cycle freeze/thaw test).

Examples of Insulated Modular Brick Panel and System Applications

Public/Government—Panels provide a durable and quality exterior for City Hall and other public buildings which require economical exteriors.

Healthcare—Panels provide the aesthetic details designers want for their health services facilities.

High—Tech Facilities—Panels provide designers with high-tech finishes and aesthetics for office buildings and campuses which accentuate their brand.

Hotels—Hospitality— Hotels, resorts, and casinos benefit from the pre-fabricated panel installation and custom designs.

Fast—Food Restaurant Chains—Panels make fast-track schedules possible and restaurant units can be fabricated in advance and shipped to job-sites regardless of location when needed.

Retail—Panels provide creative and unique details required for high-end, strip centers, big box, and specialty store unique designs.

Housing—Panels provide high-quality exteriors for multi-family, college dormitories, and government housing.

Residential—Panels provide a low-cost, energy efficient exterior for both new and retrofit applications. Brick patterns on existing exteriors can be "cloned" and matched in texture and color for retrofit or additions.

Stadiums/Sports and Entertainment Complexes—Panels provide a great source of speed and flexibility of design for these venues.

Steel/Metal Buildings—Panels provide a "brick" exterior for steel/metal buildings where code requires masonry exterior.

Custom Applications/Exteriors—Panels can be fabricated to meet the custom design requirements for existing buildings, restoration of historic buildings, parking structures, and custom artwork.

FIG. 15 shows a table of test data for a few representative embodiments of the insulated modular brick panels. The ASTM test methods shown in the table are based on results received through independent testing. All insulated modular brick panels comprise a minimal ½" thick glass fiber reinforced concrete (GFRC) coating that fully encapsulates EPS foam core. J-tracks and metal clip attachment methods are designed by a Registered Engineer. Shop and setting drawings, indicating jointing, fabrication details, setting details, and location of pieces will be provided per specific requirements of project.

Figure 16B:
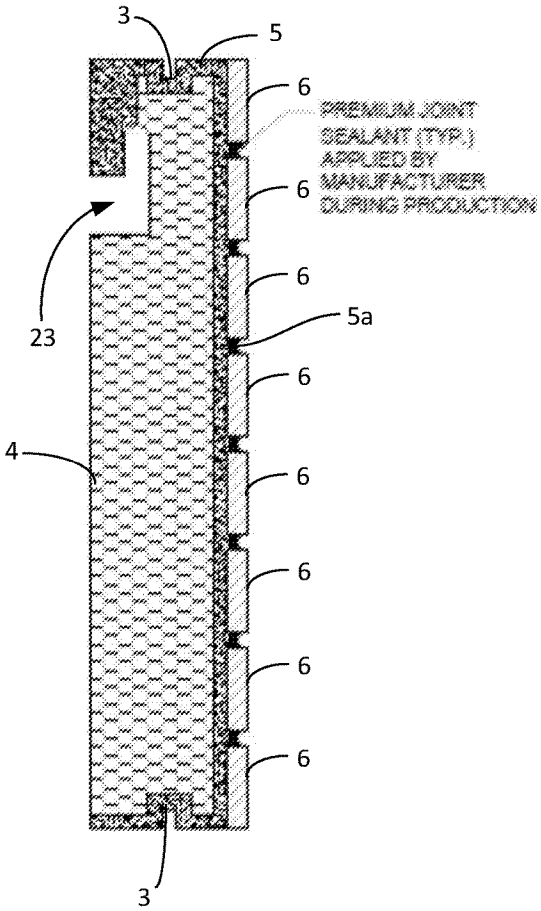
FIGS. 16A and 16B show front perspective and side cross-sectional views, respectively, of a straight insulated modular brick panel in accordance with another representative embodiment having an interlocking configuration.
Figure 16A:
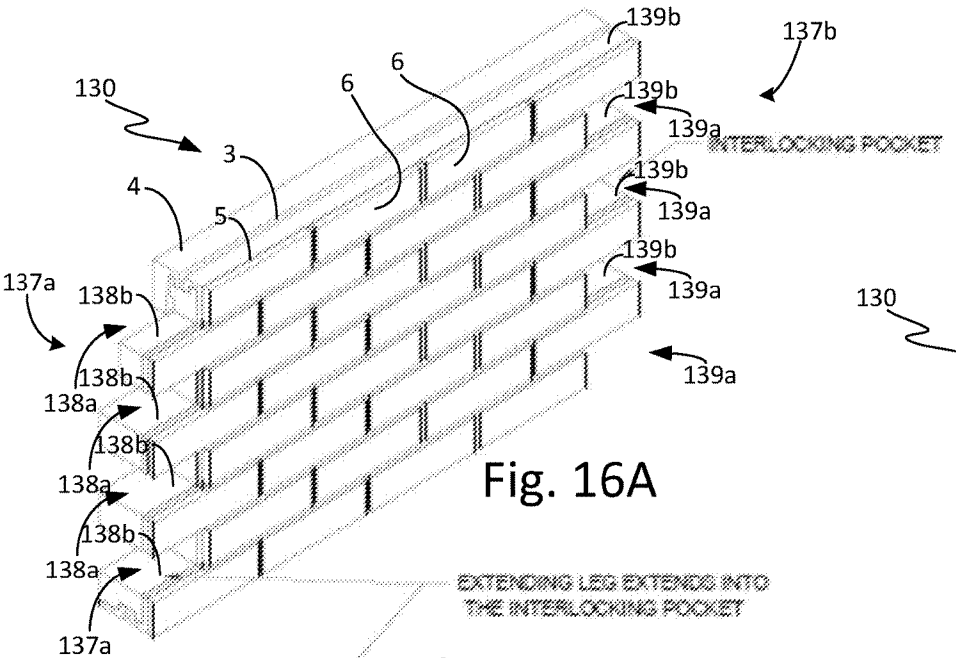

FIGS. 16A and 16B show front perspective and side cross-sectional views, respectively, of a straight insulated modular brick panel 130 in accordance with another representative embodiment having an interlocking configuration. FIG. 17 shows a front perspective view of a return insulated modular brick panel 131 in accordance with another representative embodiment having an interlocking configuration that is configured to interlock with the panel 130 shown in FIG. 16A. Each panel 130, 131 has a clip attachment portion 3 to allow straight panels 130 to be vertically stacked on like straight panels 130 and to allow return panels 131 to be stacked on like return panels 131. The panels 130 and 131 can be fabricated using the casting process described above, except that the casting process will use molds that are configured to produce the interlocking configurations.

The interlocking configuration of panel 130 comprises first and second interlocking joints 137*a* and 137*b*, respectively, that are configured to be joined with interlocking joints of either other straight panels 130 or of return panels 131, depending on the design of the insulated modular brick system. In other words, if the insulated modular brick system is designed to be more than one panel 130 in width, then a plurality of the panels 130 will be joined in the lateral direction. If the insulated modular brick system is designed to be more than one panel 130 in height, then a plurality of the panels 130 will be joined in the vertical direction. The panels 131 will interlocked with the panels 130 at the corners of the system and the panels 131 will be stacked one atop the other in the vertical direction to achieve the desired height of the system. Stacking in the vertical direction can be accomplished using the aforementioned clips and clip attachment portions in the manner described above in the installation method section. The J-track 23 are used to couple the panels 130 to the substrate of the building structure in the manner described above in the installation method section.

The interlocking joint 137*a* has interlocking pockets 138*a* and interlocking legs 138*b* that alternate row by row such that each row that ends with an interlocking pocket 138*a* is adjacent to a row that ends with an interlocking leg 138*b*. Likewise, the opposite interlocking joint 137*b* has interlocking pockets 139*a* and interlocking legs 139*b* that alternate row by row such that each row that ends with an interlocking pocket 139*a* is adjacent to a row that ends with an interlocking leg 139*b*. For each row that ends with an interlocking pocket 138*a* of interlocking joint 137*a*, the opposite end of the row ends with an interlocking leg 139*b*. Likewise, for each row that ends with an interlocking leg 138*b* of interlocking joint 137*a*, the opposite end of the row ends with an interlocking pocket 139*a*. To join two panels 130, the interlocking pockets 138*a* of a first panel 130 interlock with interlocking legs 139*b* of a second panel 130.

With reference to the return panel 131, the interlocking joints 140*a* and 140*b* are identical to the interlocking joints 137*a* and 137*b*, respectively. To join two panels 130 with the return panel 131, the interlocking pockets 138*a* of a first panel 130 interlock with interlocking legs 142*b* of the return panel 131 and the interlocking legs 139*b* of a second panel 130 interlock with interlocking pockets 141*a* of the return panel 131.

It should be noted that modifications can be made to the interlocking joints shown in FIGS. 16A-17 that enable the joints to blend and be hidden. In all other respects, the panels 130, 131 may be manufactured and installed in the manner described above, with the exception that the need for the filler bricks discussed above with reference to FIG. 14 is obviated because the interlocking joints blend or are hidden when they are joined. Some grouting will typically be performed at the joints in order to improve seamlessness.

FIG. 18 is a plan view of an example of the insulated modular brick system 150 comprising a plurality of the panels 130 and 131 showing the manner in which they are joined. In this example, twelve straight panels 130 and eight return panels 131 are used to construct the system 150, although the inventive principles and concepts are not limited to using any particular number or combination of the panels or with respect to the manner in which they are vertically joined or attached to a substrate of a building.

It should be noted that the inventive principles and concepts have been described herein with reference to a few representative embodiments, experiments and computer simulations. It will be understood by those skilled in the art in view of the description provided herein that the inventive principles and concepts are not limited to these embodiments or examples. Many modifications may be made to the systems and methods described herein within the scope of the invention, as will be understood by those of skill in the art.

What is claimed is:

1. A first insulated modular brick panel designed to be installed on a substrate of a building structure, the panel comprising:

an insulating foam core having a preselected thickness;

an encapsulating material encapsulating the insulating foam core on at least first, second and third sides of the insulating foam core; and a plurality of bricks at least partially embedded in at least a front face of the encapsulating material at preselected locations, the bricks having substantially the same dimensions, wherein said plurality of bricks comprises multiple rows of bricks at least partially embedded in the front face of the encapsulating material at preselected locations, wherein each row of bricks is offset in a lateral direction from an adjacent row of bricks by a preselected distance, and wherein the first insulated modular brick panel has at least a first joint on a first side thereof that is configured to join with a second insulated modular brick panel, wherein preselected locations in rows of the first insulated modular brick panel at the first joint are empty of bricks, the preselected locations that are empty of bricks being preselected to align and join with preselected locations in rows a second side of the second insulated modular brick panel that are empty of bricks when the first and second insulated modular brick panels are joined together, each of the aligned and joined preselected locations being sized to receive a brick having substantially the same dimensions and appearance as the bricks of said plurality of bricks.

2. The insulated modular brick panel of claim 1, wherein the encapsulating material has at least a first clip attachment formed in an upper surface thereof, the first clip attachment being configured to receive a first clip for attaching the first insulated modular brick panel to a third insulated modular brick panel in a first vertical direction that is substantially perpendicular to the lateral direction.

3. The insulated modular brick panel of claim 2, wherein the encapsulating material has at least a second clip attachment formed in a lower surface thereof, the second clip attachment being configured to receive a second clip for attaching the first insulated modular brick panel having the second clip attachment to a fourth insulated modular brick panel in a second vertical direction that is substantially opposite the first vertical direction.

4. The insulated modular brick panel of claim 3, wherein the encapsulating material has a J-track formed therein, the J-track being configured to receive an attachment mechanism for attaching the first insulated modular brick panel to the building structure such that a weight of the first insulated modular brick panel is supported by the building structure.

5. The insulated modular brick panel of claim 1, wherein the preselected distance, is equal to L/2, where L is equal to the length of each brick.

6. The insulated modular brick panel of claim 1, wherein the first insulated modular brick panel has at least a second joints on a second side thereof configured to joining the first insulated modular brick panel laterally with a third insulated modular brick panel on a first side of the third insulated modular brick panel, wherein preselected locations in rows of the third insulated modular brick panel on the first side of the insulated modular brick panel are empty of bricks, and wherein the preselected locations in the first insulated modular brick panel at the second joint that are empty of bricks align and join with preselected locations that are empty of bricks in the third insulated modular brick panel when the first and third insulated modular brick panels are joined together, each of the aligned and joined empty locations in the first and third insulated modular brick panels being sized to receive a brick having substantially the same dimensions and appearance as the bricks of said plurality of bricks.

7. The insulated modular brick panel of claim 6, wherein the first and second joints are first and second interlocking joints, respectively, the first and second interlocking joints being configured to join respective interlocking joints of the second and third insulated modular brick panels.

8. The insulated modular brick panel of claim 7, wherein the first interlocking joint has interlocking pockets and interlocking legs and wherein the second interlocking joint has interlocking pockets and interlocking legs.

9. The insulated modular brick panel of claim 8, wherein the interlocking pockets and interlocking legs of the first interlocking joint alternate row by row such that each row of the first insulated modular brick panel that ends with an interlocking pocket on the first side of the first insulated modular brick panel is adjacent to a row on the second side of the second insulated modular brick panel that ends with an interlocking leg.

10. The insulated modular brick panel of claim 9, wherein the interlocking pockets and interlocking legs of the second interlocking joint alternate row by row such that each row of the first insulated modular brick panel that ends with an interlocking pocket on the second side of the first insulated modular brick panel is adjacent to a row on a first side of the third insulated modular brick panel that ends with an interlocking leg.

11. The insulated modular brick panel of claim 1, wherein the encapsulating material is a glass fiber reinforced concrete (GFRC) coating.

12. An insulated modular brick system designed to be installed on a substrate of a building structure, the system comprising:

at least first, second and third insulated modular brick panels, the first and second modular brick panels being attached to one another in a vertical direction by an attachment mechanism that attaches a lower surface of the first insulated modular brick panel to an upper surface of the second insulated modular brick panel, each panel comprising:

an insulating foam core having a preselected thickness;

an encapsulating material encapsulating the insulating foam core on at least first, second and third sides of the insulating foam core; and a plurality of bricks at least partially embedded in at least a front face of the encapsulating material at preselected locations, the bricks having substantially the same dimensions, wherein said plurality of bricks comprises multiple rows of bricks at least partially embedded in the front face of the encapsulating material at preselected locations, wherein each row of bricks is offset from an adjacent row of bricks in a lateral direction by a preselected distance, the lateral direction being substantially perpendicular to the vertical direction;

wherein the first and third insulated modular brick panels have at least first joint and second joints on first and second sides thereof, respectively, wherein preselected locations in rows of the first and third insulated modular brick panels at the first and second joints are empty of bricks, the preselected locations that are empty of bricks in the first insulated modular brick panel being preselected to align and join with preselected locations in rows of the third insulated modular brick panel that are empty of bricks when the first and third insulated modular brick panels are joined together, each of the aligned and joined preselected locations in the first and third insulated modular brick panels being sized to receive a brick having substantially the same dimensions and appearance as the bricks of said plurality of bricks.

13. The insulated modular brick system of claim 12, wherein the attachment mechanism comprises at least a first clip attachment formed in the upper surface of the second insulated modular brick panel and a first clip received in the first clip attachment.

14. The insulated modular brick system of claim 13, wherein the attachment mechanism further comprises at least a second clip attachment formed in a lower surface of the first insulated modular brick panel and a second clip received in the second clip attachment.

15. The insulated modular brick system of claim 12, wherein the encapsulating material of at least the first insulated modular brick panels has a J-track formed therein, the J-track being configured to receive an attachment mechanism for attaching the first insulated modular brick panel to the building structure such that a weight of the first insulated modular brick panel is supported by the building structure.

16. The insulated modular brick system of claim 12, wherein the preselected distance is equal to L/2, where L is equal to the length of each brick.

17. The insulated modular brick system of claim 12, wherein the second insulated modular brick panel has at least a first joint on a first side thereof that is configured to join with a second joint on a second side of a fourth insulated modular brick panel, respectively, wherein preselected locations in rows of the second and fourth insulated modular brick panels at the first and second joints, respectively, of the second and fourth insulated modular brick panels, respectively, are empty of bricks such that when the first and second joints of the second and fourth insulated modular brick panels, respectively, are joined together, the preselected locations in rows of the second and fourth insulated modular brick panels are joined and aligned with one another, each of the aligned and joined preselected locations of the second and fourth second insulated modular brick panels being sized to receive a brick having substantially the same dimensions and appearance as the bricks of said plurality of bricks.

18. The insulated modular brick system of claim 12, wherein the encapsulating material is a glass fiber reinforced concrete (GFRC) coating.

19. A process for fabricating an insulated modular brick system, the process comprising:

forming at least a first and second insulated modular brick panels, each of the panels being formed by:

placing brick tiles in respective pockets of a customized mold, the pockets being sized and shaped to receive the brick tiles, the brick tiles having substantially the same dimensions, the pockets being arranged in multiple rows, wherein each row of the pockets is laterally offset from an adjacent row of the pockets by a preselected distance, wherein preselected locations in rows of the pockets at first and second joints of the panels being formed are left empty of brick tiles such that the panels, once formed, will have preselected locations at the first and second joints that are free of brick tiles to allow preselected locations that are free of the brick tiles at the first and second joints to align and join with one another when the first and second joints of the first and second insulated modular brick panels are joined together, respectively;

pouring an encapsulating matrix material into the mold such that the encapsulating matric material is in contact with back surfaces of the brick tiles and is disposed in between sides of adjacent brick tiles;

placing a foam core comprising insulating material in the mold in contact with the encapsulating matrix material such that a front face of the foam core is substantially parallel with the back surfaces of the brick tiles; and allowing the encapsulating matrix material to cure or harden.

* * * * *